United States Patent [19]

Hinz et al.

[11] 3,940,142

[45] Feb. 24, 1976

[54] FOLD UP DIE CONSTRUCTION

[75] Inventors: Henry Hinz, Huntington; Benjamin Stopek, West Hempstead, both of N.Y.

[73] Assignee: Ideal Toy Corporation, Hollis, N.Y.

[22] Filed: Nov. 29, 1974

[21] Appl. No.: 528,112

[52] U.S. Cl. ..... 273/146; 35/70; 46/24; 273/1 L; 273/145 C

[51] Int. Cl.[2] ..... A63F 9/04

[58] Field of Search..... 273/146; 46/1 L, 24, 25, 46/30, 31, 11; 35/69, 70, 71

[56] References Cited

UNITED STATES PATENTS

| | | | |
|---|---|---|---|
| 740,451 | 10/1903 | Mansfield | 273/146 UX |
| 1,477,255 | 12/1923 | Fritz | 35/70 |
| 2,153,053 | 4/1939 | Smith | 273/146 UX |
| 2,814,159 | 11/1957 | Green | 46/24 X |
| 3,119,621 | 1/1964 | Bookman | 273/146 X |
| 3,359,657 | 12/1967 | Hedberg | 46/24 X |
| 3,611,617 | 10/1971 | Foster et al. | 46/1 L |
| 3,612,537 | 10/1971 | Sato | 273/146 X |
| 3,744,700 | 7/1973 | Stegmann | 46/24 X |
| 3,774,339 | 11/1973 | Swett | 46/25 |

FOREIGN PATENTS OR APPLICATIONS

| | | | |
|---|---|---|---|
| 870,511 | 3/1953 | Germany | 46/24 |

*Primary Examiner*—Paul E. Shapiro
*Assistant Examiner*—Arnold W. Kramer
*Attorney, Agent, or Firm*—Richard M. Rabkin

[57] ABSTRACT

A die for use in a liquid filled die agitator is formed from a foldable, initially flat sheet having a plurality of discreet sections respectively adapted to define facets of the die. The sheet sections are integrally formed with one another and each is joined to at least one adjacent section by an integral foldable joint, with the sections being arrayed in a predetermined pattern so that upon folding about their associated joints, the sections will form the facets of the die. Cooperating recesses and mating posts on at least some of the sheet sections secure the sections together in the folded configuration to complete the die, while guide pins on at least some of these sections guide the sections into mating relation with one another during the folding operation.

19 Claims, 9 Drawing Figures

FIG. 1
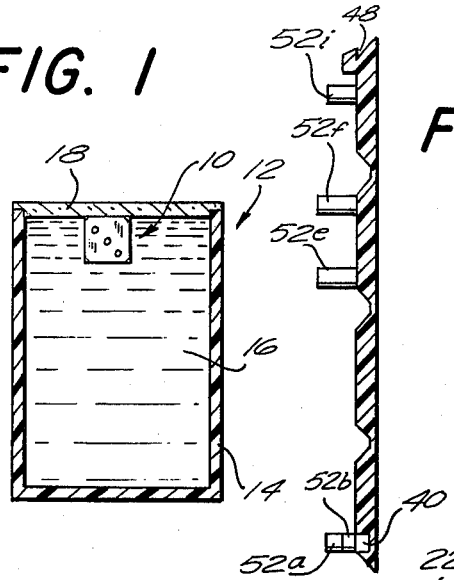
FIG. 5
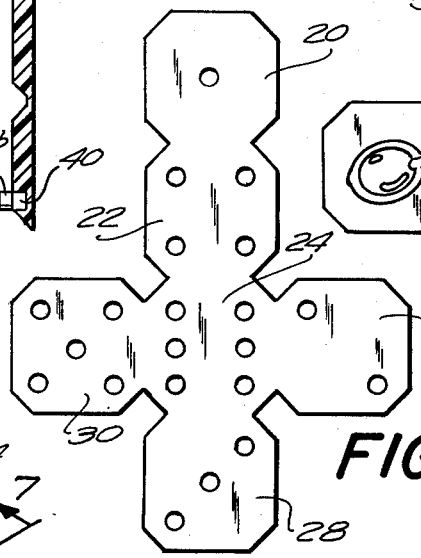
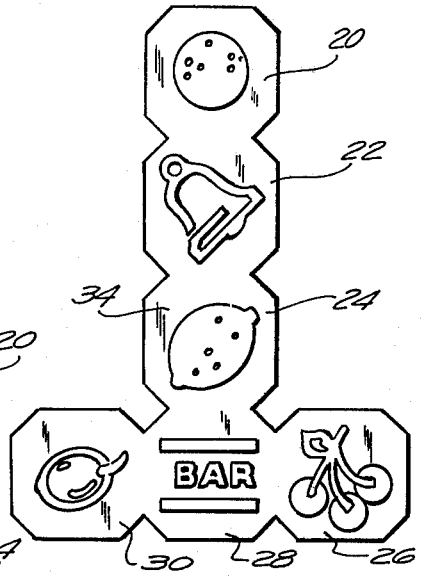
FIG. 8
FIG. 9
FIG. 2
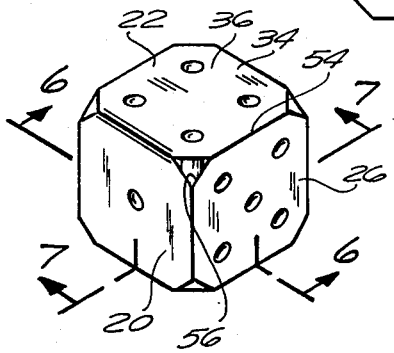
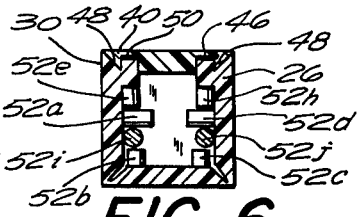
FIG. 6
FIG. 7
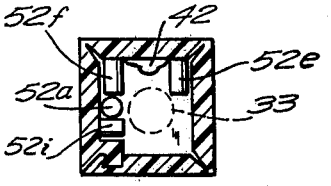
FIG. 3
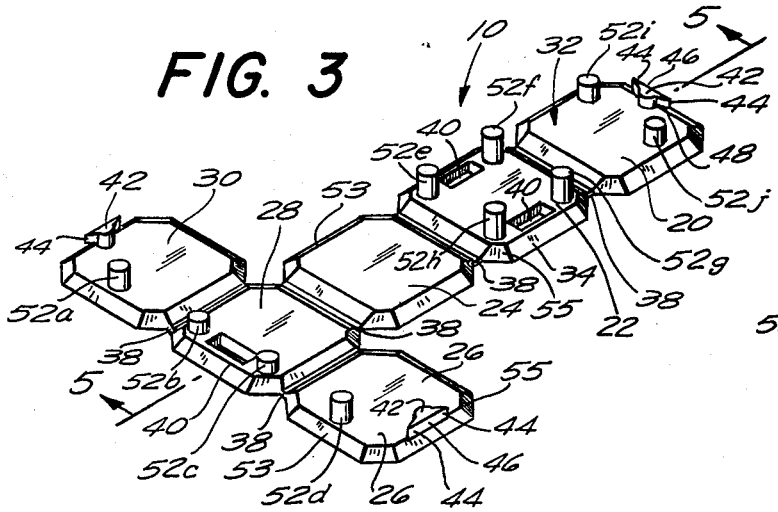
FIG. 4
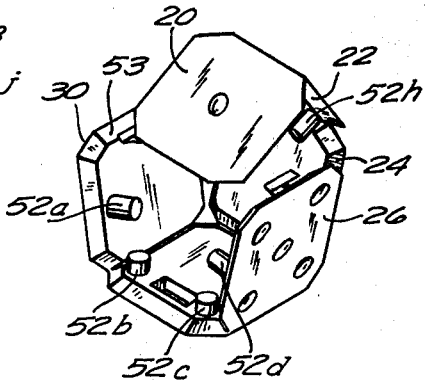

FOLD UP DIE CONSTRUCTION

The present invention relates to a die member and more particularly to a hollow foldable die member adapted to be used in a liquid filled die agitator.

The use of dice or individual die members in games of chance has been known throughout the history of man. One such game involves placing a buoyant die member in a liquid filled die agitator which is used to randomly cause a facet of the die to appear adjacent an upper transparent surface of the agitator during the course of the game. Games of this type are shown, for example, in U.S. Pat. Nos. 3,119.621 and 3,168,315. In these types of games, the die used in the agitator is of critical importance in order to insure satisfactory operation of the agitator. It is necessary that the die be properly buoyant so as to insure that the facets thereof become properly exposed through the transparent surface of the agitator. In the past it has been relatively difficult and expensive to form die members having the desired buoyancy characteristics.

Accordingly, it is an object of the present invention to produce a die member for use in a liquid agitator which overcomes the problems inherent in previously proposed die structures.

Another object of the present invention is to provide a die member which is relatively inexpensive to manufacture.

A further object of the present invention is to provide a die member which can be formed initially as a flat one piece member and readily folded into a completed hollow die construction.

A still further object of the present invention is to provide a one piece foldable die member which is easily folded into a completed die construction with the folded sections of the die held securely in fixed positions with respect to each other.

In accordance with one aspect of the present invention, a die member is formed from a foldable flat sheet, preferably of a buoyant plastic material, which has inner and outer surfaces on opposite sides thereof and six integrally formed sections adapted to respectively define facets of a generally cubical die. The foldable sheet includes foldable joint means integrally formed therewith, for example as thin strips between adjacent sheet sections, for foldably joining each of the sheet sections to at least one other sheet section. The sections of the foldable flat sheet are arrayed in a predetermined pattern so that upon folding of at least some of the sections through 90°, about the joints therebetween and in a direction towards the inner side of the sheet, the sheet sections will form the facets of the die. Cooperating means are formed on at least some of these sheet sections for securing the sections together in a complete folded die configuration. Preferably, the sheet sections are arrayed generally in a T-shaped pattern in the initial flat or unfolded configuration of the die. In addition, certain of the sheet sections are provided with cooperating pins which extend from the inner side of the sheet in a predetermined pattern to define guide passageways therebetween which receive and guide each other during the folding operation to insure that each of the facets are properly positioned with respect to one another prior to securement of the sheet in the fixed folded die configuration by the cooperating means. At least some of these cooperating pins are arrayed in position to engage each other in a pressure or resilient contact to aid in maintaining the cooperating means securing the sections together in engagement.

The above, and other objects, features and advantages of this invention will be apparent from the following detailed description thereof when read in connection with the accompanying drawing, wherein:

FIG. 1 is an elevational view, in section, of a liquid filled die agitator containing a die constructed in accordance with the present invention;

FIG. 2 is an enlarged perspective view of a die constructed in accordance with the present invention;

FIG. 3 is a perspective view of the die shown in FIG. 1 in its unfolded configuration;

FIG. 4 is a perspective view showing the die of FIG. 3 in a partially folded configuration;

FIG. 5 is a longitudinal sectional view taken along line 5—5 of FIG. 3;

FIGS. 6 and 7 are sectional views taken along lines 6—6 and 7—7 respectively of FIG. 2;

FIG. 8 is a plan view of a die member constructed in accordance with another embodiment of the present invention wherein a different set of indicia is formed on the die facets; and FIG. 9 is a plan view of yet another embodiment of the invention.

Referring now to the drawing in detail, and initially to FIG. 1 thereof, it will be seen that a die 10 constructed in accordance with the present invention is adapted to be contained within a liquid filled die agitator 12. The latter may be of the type of agitator shown in the above-mentioned patents, and basically includes a cup or cylinder 14 formed from a suitably opaque plastic material which contains a suitable liquid 16. The upper end of the cup 14 has a transparent top 18 which is secured to the cup in liquid tight relation in any convenient manner. The die 10 is formed of a material which has a density slightly lighter than the density of the fluid 16 to provide the desired operating buoyancy for the member so that the die will rise to the top of the agitator. It has been found, for example, that polypropylene is a suitable material for forming the die 10. Polystyrene can also be used to form the die, and a Styrofoam bead can be inserted in the die, if desired, to provide floatation and buoyancy, particularly when the specific gravity of the liquid 16 exceeds that of water.

In the illustrative embodiment of the invention, die 10 is formed as a generally cubical member having conventional dot arrays representative of the numerals 1–6 (see FIG. 2) and is agitated in container 14, as by inverting the container, in order to cause the facets of the die to become randomly engaged with the cover 18 of the container for exposure therethrough during the play of a game. Preferably, the liquid is dyed with a contrasting color so that if the numerals or indicia on the die are raised only the indicia engage the cover 18 and the liquid, in effect, covers and hides the remainder of the facet or die. On the other hand where the indicia are formed as depressions on the die facet the dyed liquid will enter the indicia and the die facet will engage cover 18 so that the facet is exposed with pockets of the contrasting liquid in the facets indicia-recesses.

Referring to FIGS. 2–4 of the drawing, it will be seen that the die 10 is formed by folding a single flat sheet or strip of flexible material. This strip can be formed in any convenient manner, as for example by cutting from a preformed sheet of material or by any well known molding process. In any case, the die 10 includes a plurality of sections 20, 22, 24, 26, 28, and 30 which in the completed die form facets of the die. The die sheet has inner and outer surfaces 32, 34 respectively, with the dot indicia 36 formed preferably as recesses in the outer surface 34 of the facets. Alternatively, this dot structure can be formed as raised embossments on the surface 34 during the molding process.

The sheet sections or facets are integrally formed in a one piece construction and are interconnected by thin sheet segments or joints 38. These joints have a thickness which is substantially less than the thickness of the individual sheet sections, so that they are foldable to allow the sheet sections or facets to be folded with respect to one another about the interconnecting joints.

As will be apparent from FIG. 3, the individual sheet sections or facets are arrayed in a generally T-shaped pattern with the facets 20, 22, 24 forming the stem of the T and the facets 26, 28, 30 forming the crossbar. By this arrangement, the individual facets can be folded from the flat configuration thereof shown in FIG. 3 to the completed folded configuration thereof in FIG. 2, simply by folding the individual facets about the joints 38. An intermediate position of the facets, between the unfolded and folded configurations thereof, is shown in FIG. 4. From that figure it will be apparent that each of the facets 20, 22, 24, 26 and 30, is folded at 90° about its associated joint 38, with respect to its adjacent facet, and towards the inner side 32 of the die sheet in order to arrive at the completed folded configuration of the die. In this manner, a hollow die is provided which has improved buoyancy for use in the liquid die agitator. To further improve the buoyancy of the die a floatation bead formed of Styrofoam or the like can be placed in the die during the folding operation; for example as shown at 33 in FIG. 7.

In order to maintain the folded configuration of the die, the sheet material of which the die is formed is provided with integral cooperating means that serve to secure the die sections in the folded configuration with the marginal edges of each die section in abutting engagement with the edges of its adjacent sections. These cooperating means include a plurality of recesses 40 formed on the inner surface 32 of certain of the die sections or facets and a similar number of cooperating posts 42 formed on the inner surface of other of the facets. In the illustrative embodiment, it will be seen that the recesses 40 are formed in facets 22, 28 while posts 42 are formed in the facets 20, 26 and 30. The recesses 40 are generally rectangular in configuration and are adapted to receive a portion of the posts 42 therein in a friction-tight fit.

Posts 42 are formed as projections which extend perpendicularly from the inner surface 32 of their associated sheet sections and have integral lateral extensions 44 formed therewith. The extensions 44 are dimensioned to be substantially equal in length to the maximum dimension of the rectangular recesses 40, and have a height which is substantially equal to the minor dimension of the rectangular recesses. In addition, as seen in FIG. 6, the outer side 46 of the extensions 44 are under cut, as at 48, so that the extensions can be received in recesses 40 with the surfaces 46 thereof adjacent the base 50 of the recess and the upper and lower sides of the extensions engaged against the sides of the recesses in a friction tight fit which firmly holds the adjacent sheet sections together. It will be appreciated that the cooperating recesses and projections 40, 42 are formed on sheet sections or facets which will extend at 90° with respect to one another in the complete folded configuration of the die in order to insure that the various facets are held securely in their relative positions.

Die 10 is also provided with a plurality of projecting pins 52 extending perpendicularly from the inner surface 32 of some of the sheet sections, which form guides to insure proper alignment of the die facets with respect to one another. For convenience in following the locations of the various pins 52 in the drawings, the pins have been identified with the subscripts a-j.

Pins 52, in effect, form passageways or slots between themselves in the folding of the die in order to guide the remaining pins, and the posts 42, into proper relative position with respect to one another and the recesses 40, so that the folding operation can be performed with accuracy and a minimum of difficulty. Thus, as seen in FIGS. 6 and 7, the pins will extend into the spaces or passages formed between themselves as the die is folded, so that substantially all of the pins act to guide the facets into their proper relative positions. In addition, pins **52*i* and 52*j* are dimensioned to engage pins 52*a* and 52*d* (as seen in FIG. 6) in a pressure or resilient contact so that the resilient engagement therebetween urges the posts 42 on facets 26, 30 into the recesses 40 on facet 22** to insure a positive lock in the closed die.

Each of the die sections or facets has a generally square configuration in plan, and includes four outer edges. The edges 53 of each section are mitered from the inner side 32 toward the outer side 34 of the section, in order to define inclined surfaces about each facet. These surfaces are preferably inclined at an angle of 45° with respect to the inner and outer surfaces thereof, so that when the die sheet is folded the surfaces 53 will abut one another in marginally contacting relationship, in order to form straight edges 54 along the sides of the completed die. The corners 55 of each die section or facet is cut off in order to provide inclined edge segments. In the completed die configuration these edge segments 55 will form triangular openings 56 at each corner of the die (see FIG. 2) thereby providing access to the interior of the die.

Although the die of the present invention has been described particularly for use in a liquid filled die agitator, it will be appreciated that the die can also be used in other types of dice games. The securement between the die facets formed by the recesses and posts 40, 42 is sufficient so that the die can withstand substantial abuse without unfolding. In addition, although the die has been shown with embossed dot arrays representative of numerals, the facets of the die can be formed with other types of distinguishing indicia. This is shown for example in FIG. 8 where other distinguishing indicia are illustrated on the outer side 34 of each of the die facets. Again, these indicia either can be formed as recesses in the outer surface 34 of the facets or as embossments thereon.

Still further, the T-shaped array of the facet sections of the die may be formed as a T-shape with an array such as is shown in FIG. 9, wherein the facets 26, 30 are connected to facet 24, rather than facet 28. Thus, the term "T-shaped" as used herein is intended to include both the array of FIG. 3 and the array of FIG. 9. As will be apparent however, the arrangement of the posts and guide pins on facets 26 and 30 would remain the same.

Although illustrative embodiments of the present invention have been described herein with reference to the accompanying drawings, it will be appreciated that various changes and modifications can be effected therein without departing from the scope or spirit of this invention.

What is claimed is:

1. A die member comprising a foldable, initially flat sheet having a plurality of discrete sections respectively adapted to define a facet of the die; said sections being integrally formed with one another and joined to at least one adjacent section by an integral foldable joint, said sections and joints being arrayed in a predetermined pattern whereby upon folding of said sections about their associated joints the sheet sections form the facets of a die; cooperating means on at least some of said sheet sections for securing said sections together in a complete folded die configuration; and guide means on at least some of said sections for guiding the sections into mating relation with one another during folding; said guide means comprising a plurality of guide pins extending generally perpendicularly from one side of said sheet on a plurality of said sections, said one side of said sheet defining the interior of the die upon folding of the sections, and said guide pins being arrayed in a predetermined pattern to define guide passageways therebetween which receive and guide the pins with respect to one another.

2. The die as defined in claim 1 wherein said cooperating means include a plurality of recesses formed in certain of said sections and a plurality of cooperating posts formed on other of said sections and adapted to be received in said recesses in a friction tight fit to hold said sections together upon folding of said sheet.

3. The die as defined in claim 1 wherein said sheet sections have complementary free edge portions adapted to engage each other in the folded configuration of the sheet.

4. The die as defined in claim 3 wherein said free edges are mitered at complementary angles.

5. The die as defined in claim 3 wherein said sections have a substantially identical polygonal configuration in plan and each includes a plurality of corners formed therein between each adjacent side of the section.

6. The die as defined in claim 5 wherein each of said corners is formed as an edge section extending angularly between the adjacent edges of its associated sheet section whereby said corners, in the folded configuration of the sheet, define openings providing access into the interior of the die.

7. A die member comprising a foldable flat sheet having inner and outer surfaces on opposite sides thereof and six integrally formed sections adapted to respectively define facets of a generally cubical die; said sheet including foldable joint means integrally formed therewith for foldably joining each of said sheet sections to at least one other sheet section; said sheet sections being arrayed in a predetermined pattern whereby upon folding of at least some of said sections through 90° about said joint means, and in a direction towards the inner side of said sheet, the sheet sections form the facets of the die; cooperating means formed on at least some of said sheet sections for securing the sections together in a completed folded die configuration; and guide means formed on the inner side of said sheet on at least some of said sections for guiding the sections into mating relation with one another during folding, said guide means comprising a plurality of guide pins extending generally perpendicularly from the inner side of said sheet on at least some of said sheet sections and being arrayed in a predetermined pattern to define guide passages therebetween which receive and guide the pins with respect to one another.

8. The die as defined in claim 7 wherein said sheet sections are arrayed in a generally T-shaped pattern.

9. The die as defined in claim 8 wherein said cooperating means are formed on at least two of said sheet sections; said at least two sheet sections extending generally perpendicular to each other in the folded configuration of the die.

10. The die as defined in claim 9 wherein said at least two sheet sections are located respectively in the stem and cross-bar of said T-shaped pattern.

11. The die as defined in claim 8 wherein said sheet sections are substantially square in plan and have perpendicularly extending edges; one of said sheet sections having a pair of joint means formed along opposite edges thereof and being joined thereby to two other sheet sections to form the cross-bar of said T-shaped pattern; the other three sheet sections being joined to one another in lineal alignment by a second pair of joint means to form the stem of said T-shaped pattern; and said one sheet section having another joint means formed along a third edge and being joined thereby to one of the sheet sections in said stem.

12. The die as defined in claim 11 wherein said cooperating means are formed on pairs of sheet sections extending perpendicularly to each other in the folded configuration of the die with the sheet sections of each of said pairs being located respectively in the stem and cross-bar of said T-shaped pattern.

13. The die as defined in claim 12 wherein said cooperating means on each of said pairs of perpendicularly extending sheet sections comprise a recess formed in one section of said pairs and a generally mating post adapted to be frictionally fit in said recess.

14. The die as defined in claim 12 wherein said sheet sections have complementary free edge portions adapted to engage each other in the folded configuration of the sheet.

15. The die as defined in claim 14 wherein said free edges are mitered at complementary angles.

16. The die as defined in claim 15 wherein the corners of each of said sheet sections, between the edges thereof, are mitered and formed as an edge section extending angularly between the adjacent edges of the sheet section whereby said corners, in the folded configuration of the sheet, define openings providing access into the interior of the die.

17. The die as defined in claim 11 wherein said joint means each comprises a portion of the sheet, between adjacent sheet sections, which has a smaller thickness than its adjacent sheet sections.

18. The die as defined in claim 11 having distinguishing indicia formed on the outer side of each of said sections.

19. The die as defined in claim 11 wherein said sheet is formed of a buoyant material.

* * * * *